US010619445B2

(12) United States Patent
Murphree et al.

(10) Patent No.: US 10,619,445 B2
(45) Date of Patent: Apr. 14, 2020

(54) DEGRADABLE DOWNHOLE TOOLS COMPRISING RETENTION MECHANISMS

(71) Applicant: Halliburton Energy Services, Inc., Houston, TX (US)

(72) Inventors: Zachary Murphree, Dallas, TX (US); Michael Linley Fripp, Carrollton, TX (US); Charles Timothy Smith, McKinney, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 216 days.

(21) Appl. No.: 14/765,612

(22) PCT Filed: Aug. 13, 2014

(86) PCT No.: PCT/US2014/050836
§ 371 (c)(1),
(2) Date: Aug. 4, 2015

(87) PCT Pub. No.: WO2016/024961
PCT Pub. Date: Feb. 18, 2016

(65) Prior Publication Data

US 2016/0251928 A1 Sep. 1, 2016

(51) Int. Cl.

| | |
|---|---|
| ***E21B 23/01*** | (2006.01) |
| ***E21B 33/12*** | (2006.01) |
| ***E21B 33/129*** | (2006.01) |
| ***E21B 33/128*** | (2006.01) |

(52) U.S. Cl.
CPC ..... *E21B 33/12* (2013.01); *E21B 23/01* (2013.01); *E21B 33/1208* (2013.01); *E21B 33/128* (2013.01); *E21B 33/129* (2013.01)

(58) Field of Classification Search
CPC ..... E21B 23/01; E21B 33/12; E21B 33/1208; E21B 33/128; E21B 33/129
See application file for complete search history.

(56) References Cited

U.S. PATENT DOCUMENTS

| | | | |
|---|---|---|---|
| 4,921,045 | A | 5/1990 | Richardson |
| 5,560,800 | A | 10/1996 | Liu et al. |
| 6,076,600 | A | 6/2000 | Vick, Jr. et al. |
| 6,722,451 | B2 | 4/2004 | Saugier |

(Continued)

FOREIGN PATENT DOCUMENTS

| | | | |
|---|---|---|---|
| WO | 2011112447 | A2 | 9/2011 |
| WO | 2015060826 | A1 | 4/2015 |
| WO | 2016024961 | A1 | 2/2016 |

OTHER PUBLICATIONS

International Search Report and Written Opinion for PCT/US2014/050836 dated May 13, 2015.

(Continued)

*Primary Examiner* — David J Bagnell
*Assistant Examiner* — Dany E Akakpo
(74) *Attorney, Agent, or Firm* — McGuireWoods, LLP

(57) ABSTRACT

Downhole tools comprising a body and at least one sealing element, wherein at least a portion of the body is degradable when exposed to a wellbore environment; and a retention mechanism configured to retain the sealing element in place during degradation of the portion of the body that is degradable, wherein the downhole tool is capable of actuating to fluidly seal two sections of the wellbore with the sealing element.

12 Claims, 2 Drawing Sheets

(56) References Cited

U.S. PATENT DOCUMENTS

| | | | | |
|---|---|---|---|---|
| 7,059,410 | B2 | 6/2006 | Bousche et al. | |
| 7,353,879 | B2 | 4/2008 | Todd et al. | |
| 7,373,973 | B2 | 5/2008 | Smith et al. | |
| 7,699,101 | B2 | 4/2010 | Fripp et al. | |
| 8,181,708 | B2 | 5/2012 | Korte et al. | |
| 8,573,295 | B2 | 11/2013 | Johnson et al. | |
| 8,651,179 | B2 * | 2/2014 | Vaidya | E21B 33/1208 166/179 |
| 9,500,061 | B2 * | 11/2016 | Frazier | E21B 33/1208 |
| 9,605,509 | B2 * | 3/2017 | Doane | E21B 33/1208 |
| 2005/0011650 | A1 * | 1/2005 | Harrall | E21B 29/00 166/380 |
| 2005/0205266 | A1 * | 9/2005 | Todd | E21B 23/00 166/376 |
| 2008/0023205 | A1 * | 1/2008 | Craster | E21B 23/06 166/387 |
| 2010/0181080 | A1 | 7/2010 | Levy | |
| 2010/0236794 | A1 | 9/2010 | Duan et al. | |
| 2011/0297265 | A1 * | 12/2011 | Kahoe | E21B 33/064 138/98 |
| 2012/0125630 | A1 | 5/2012 | Sevre | |
| 2012/0292014 | A1 | 11/2012 | Bishop | |
| 2013/0299192 | A1 | 11/2013 | Xu et al. | |
| 2014/0190685 | A1 | 7/2014 | Frazier et al. | |

OTHER PUBLICATIONS

Canadian Office Action from Canadian Patent Application No. 2,951,629, dated Oct. 26, 2017, 3 pages.

* cited by examiner

DEGRADABLE DOWNHOLE TOOLS COMPRISING RETENTION MECHANISMS

BACKGROUND

The present disclosure generally relates to degradable downhole tools comprising retention mechanisms and, more specifically, to downhole tools comprising a body that is at least partially degradable, a sealing element, and a retention mechanism configured to retain the sealing element in place during degradation of the body.

A variety of downhole tools are within a wellbore in connection with producing or reworking a hydrocarbon bearing subterranean formation. The downhole tool may comprise a wellbore zonal isolation device capable of fluidly sealing two sections of the wellbore from one another and maintaining differential pressure (i.e., to isolate one pressure zone from another). The wellbore zonal isolation device may be used in direct contact with the formation face of the wellbore, with casing string, with a screen or wire mesh, and the like.

After the production or reworking operation is complete, the seal formed by the downhole tool must be broken and the tool itself removed from the wellbore. The downhole tool must be removed to allow for production or further operations to proceed without being hindered by the presence of the downhole tool. Removal of the downhole tool(s) is traditionally accomplished by complex retrieval operations involving milling or drilling the downhole tool for mechanical retrieval. In order to facilitate such operations, downhole tools have traditionally been composed of drillable metal materials, such as cast iron, brass, or aluminum. These operations can be costly and time consuming, as they involve introducing a tool string (e.g., a mechanical connection to the surface) into the wellbore, milling or drilling out the downhole tool (e.g., at least breaking the seal), and mechanically retrieving the downhole tool or pieces thereof from the wellbore to bring to the surface.

To reduce the cost and time required to mill or drill a downhole tool from a wellbore for its removal, degradable downhole tools have been developed. However, during degradation, the downhole tool may lose its fluid seal with the wellbore, thereby allowing flowback of portions of the downhole tool that are not sufficiently degraded. Flowback of such non-degraded portions may cause damage to operation equipment (e.g., dogging tubulars) and result in costly remedial measures in terms of both time and monetary expense.

BRIEF DESCRIPTION OF THE DRAWINGS

The following figures are included to illustrate certain aspects of the embodiments, and should not be viewed as exclusive embodiments. The subject matter disclosed is capable of considerable modifications, alterations, combinations, and equivalents in form and function, as will occur to those skilled in the art and having the benefit of this disclosure.

DETAILED DESCRIPTION

Figure 1:
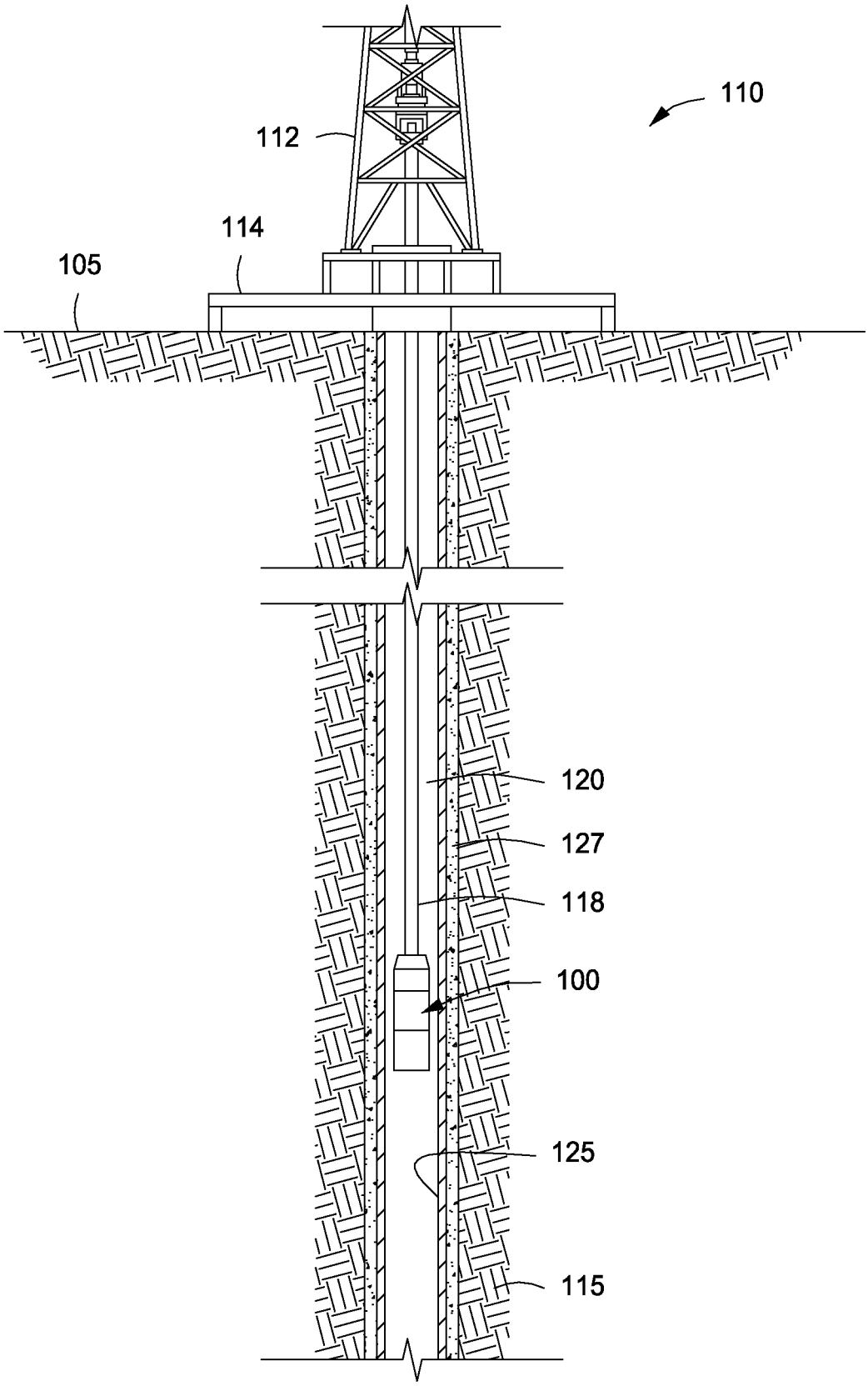
FIG. 1 illustrates a cross-sectional view of a well system comprising a downhole tool, according to one or more embodiments described herein.

The present disclosure generally relates to degradable downhole tools comprising retention mechanisms and, more specifically, to downhole tools comprising a body that is at least partially degradable, a sealing element, and a retention mechanism configured to retain the sealing element in place during degradation of the body. As used herein, the term "retention mechanism" refers to a means of holding a sealing element comprising part of a downhole tool at a location downhole while portions of the downhole tool are degraded. As used herein, the term "degradable" and all of its grammatical variants (e.g., "degrade," "degradation," "degrading," and the like) refers to the dissolution or chemical conversion of materials into smaller components, intermediates, or end products by at least one of solubilization, hydrolytic degradation, biologically formed entities (e.g., bacteria or enzymes), chemical reactions, electrochemical processes, thermal reactions, or reactions induced by radiation. In some instances, the degradation of the material may be sufficient for the mechanical properties of the material to reduce to a point that the material no longer maintains its integrity and, in essence, falls apart. The conditions for degradation are generally wellbore conditions where an external stimuli may be used to initiate or effect the rate of degradation. For example, the pH of the fluid that interacts with the material may be changed by introduction of an acid or a base. The term "wellbore environment" includes both naturally occurring wellbore environments and introduced materials into the wellbore. As discussed in detail below, degradation of the body may be accelerated, rapid, or normal, degrading anywhere from about 30 minutes to about 40 days from first contact with the appropriate wellbore environment.

Disclosed are various embodiments of a downhole tool, including a sealing element capable of fluidly sealing two sections of a wellbore (which may be also referred to as "setting" the downhole tool). The downhole tool may have various setting mechanisms for fluidly sealing the sections of the wellbore with the sealing element including, but not limited to, hydraulic setting, mechanical setting, setting by swelling, setting by inflation, and the like. The downhole tool may be a well isolation device, such as a frac plug, a bridge plug, or a packer, a wiper plug, a cement plug, or any other tool requiring a sealing element for use in a downhole operation. Such downhole operations may include, but are not limited to, any type of fluid injection operation (e.g. a stimulation/fracturing operation, a pinpoint acid stimulation, casing repair, and the like), and the like.

In some embodiments, at least a portion of the sealing element may also be degradable upon exposure to the wellbore environment. The embodiments herein permit fluid sealing of two wellbore sections with a downhole tool having a body that is at least partially degradable in situ, preferably without the need to mill or drill and retrieve the downhole tool from the wellbore. The portion of the body that is degradable may drop into a rathole in the wellbore without the need for retrieval or may be sufficiently degraded in the wellbore so as to be generally indiscernible. During such degradation, a retention mechanism is employed to ensure that the sealing element remains in place in the wellbore to prevent flowback of non-degraded portions of the downhole tool (i.e., portions of the body and/or sealing element).

One or more illustrative embodiments disclosed herein are presented below. Not all features of an actual implementation are described or shown in this application for the sake of clarity. It is understood that in the development of an actual embodiment incorporating the embodiments disclosed herein, numerous implementation-specific decisions must be made to achieve the developer's goals, such as compliance with system-related, lithology-related, business-related, government-related, and other constraints, which vary by implementation and from time to time. While a developer's efforts might be complex and time-consuming, such efforts would be, nevertheless, a routine undertaking for those of ordinary skill in the art having benefit of this disclosure.

It should be noted that when "about" is provided herein at the beginning of a numerical list, the term modifies each number of the numerical list. In some numerical listings of ranges, some lower limits listed may be greater than some upper limits listed. One skilled in the art will recognize that the selected subset will require the selection of an upper limit in excess of the selected lower limit. Unless otherwise indicated, all numbers expressed in the present specification and associated claims are to be understood as being modified in all instances by the term "about." Accordingly, unless indicated to the contrary, the numerical parameters set forth in the following specification and attached claims are approximations that may vary depending upon the desired properties sought to be obtained by the exemplary embodiments described herein. At the very least, and not as an attempt to limit the application of the doctrine of equivalents to the scope of the claim, each numerical parameter should at least be construed in light of the number of reported significant digits and by applying ordinary rounding techniques.

While compositions and methods are described herein in terms of "comprising" various components or steps, the compositions and methods can also "consist essentially of" or "consist of" the various components and steps. When "comprising" is used in a claim, it is open-ended.

The use of directional terms such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

Referring now to FIG. 1, illustrated is an exemplary well system 110 for a downhole tool 100. As depicted, a derrick 112 with a rig floor 114 is positioned on the earth's surface 105. A wellbore 120 is positioned below the derrick 112 and the rig floor 114 and extends into subterranean formation 115. As shown, the wellbore 120 may be lined with casing 125 that is cemented into place with cement 127. It will be appreciated that although FIG. 1 depicts the wellbore 120 having a casing 125 being cemented into place with cement 127, the wellbore 120 may be wholly or partially cased and wholly or partially cemented (i.e., the casing wholly or partially spans the wellbore 120 and may or may not be wholly or partially cemented in place), without departing from the scope of the present disclosure. Moreover, the wellbore 120 may be an open-hole wellbore. A tool string 118 extends from the derrick 112 and the rig floor 114 downwardly into the wellbore 120. The tool string 118 may be any mechanical connection to the surface, such as, for example, wireline, slickline, jointed pipe, or coiled tubing. As depicted, the tool string 118 suspends the downhole tool 100 for placement into the wellbore 120 at a desired location to perform a specific downhole operation. As previously mentioned, the downhole tool 100 may be any type of wellbore zonal isolation device including, but not limited to, a frac plug, a bridge plug, a packer, a wiper plug, or a cement plug.

It will be appreciated by one of skill in the art that the well system 110 of FIG. 1 is merely one example of a wide variety of well systems in which the principles of the present disclosure may be utilized. Accordingly, it will be appreciated that the principles of this disclosure are not necessarily limited to any of the details of the depicted well system 110, or the various components thereof, depicted in the drawings or otherwise described herein. For example, it is not necessary in keeping with the principles of this disclosure for the wellbore 120 to include a generally vertical cased section. The well system 110 may equally be employed in vertical and/or deviated wellbores, without departing from the scope of the present disclosure. Furthermore, it is not necessary for a single downhole tool 100 to be suspended from the tool string 118.

In addition, it is not necessary for the downhole tool 100 to be lowered into the wellbore 120 using the derrick 112. Rather, any other type of device suitable for lowering the downhole tool 100 into the wellbore 120 for placement at a desired location may be utilized without departing from the scope of the present disclosure such as, for example, mobile workover rigs, well servicing units, and the like. Although not depicted, the downhole tool 100 may alternatively be hydraulically pumped into the wellbore and, thus, not need the tool string 118 for delivery into the wellbore 120.

Although not depicted, the structure of the downhole tool 100 may take on a variety of forms to provide fluid sealing between two wellbore sections. The downhole tool 100, regardless of its specific structure as a specific type of wellbore zonal isolation device, comprises a body and a sealing element. Both the body and the sealing element may each be composed of the same material. Generally, however, the body provides structural rigidity and other mechanical features to the downhole tool 100 and the sealing element is a resilient (i.e., elastic) material capable of providing a fluid seal between two sections of the wellbore 120.

Figure 2:
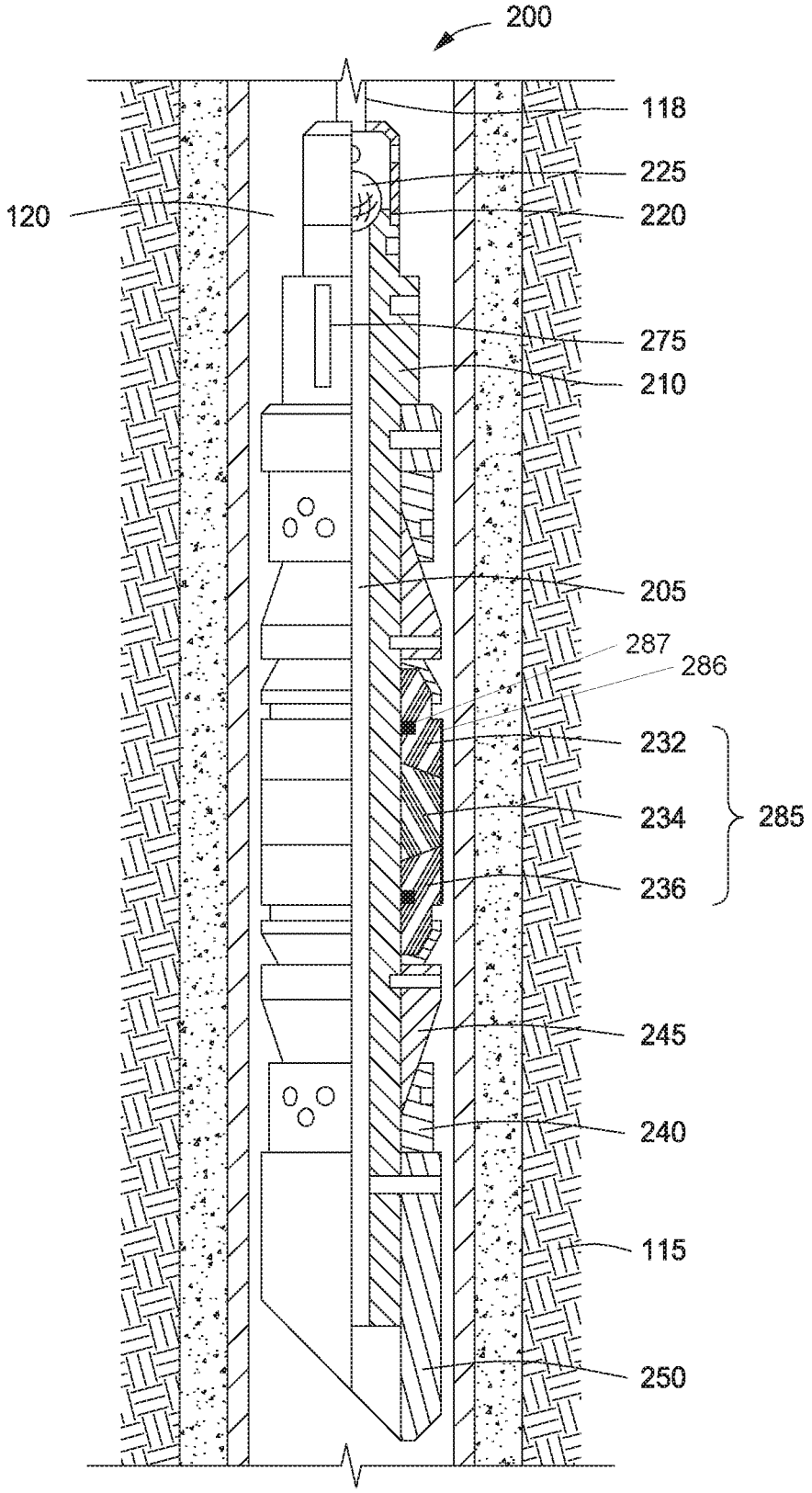
FIG. 2 depicts an enlarged cross-sectional view of a downhole tool, according to one or more embodiments described herein.

Referring now to FIG. 2, with continued reference to FIG. 1, one specific type of downhole tool described herein is a frac plug wellbore zonal isolation device for use during a well stimulation/fracturing operation. FIG. 2 illustrates a cross-sectional view of a frac plug 200 being lowered into a wellbore 120 on a tool string 118. As previously mentioned, the frac plug 200 generally comprises a body 210 and a sealing element 285. The sealing element 285, as depicted, comprises an upper sealing element 232, a center sealing element 234, and a lower sealing element 236. It will be appreciated that although the sealing element 285 is shown as having three portions (i.e., the upper sealing element 232, the center sealing element 234, and the lower sealing element 236), any other number of portions, or a single portion, may also be employed without departing from the scope of the present disclosure.

As depicted, the sealing element 285 is extending around the body 210; however, it may be of any other configuration suitable for allowing the sealing element 285 to form a fluid seal in the wellbore 120, without departing from the scope of the present disclosure. For example, in some embodiments, the body may comprise two sections joined together by the sealing element, such that the two sections of the body compress to permit the sealing element to make a fluid seal in the wellbore 120, termed "actuating" the downhole tool. Other such configurations are also suitable for use in the embodiments described herein. Moreover, although the sealing element 285 is depicted as located in a center section of the body 210, it will be appreciated that it may be located at any location along the length of the body 210, without departing from the scope of the present disclosure.

The body 210 of the frac plug 200 comprises an axial flowbore 205 extending therethrough. A cage 220 is formed at the upper end of the body 210 for retaining a ball 225 that acts as a one-way check valve. In particular, the ball 225 seals off the flowbore 205 to prevent flow downwardly therethrough, but permits flow upwardly through the flowbore 205. A tapered shoe 250 is provided at the lower end of the body 210 for guiding and protecting the frac plug 200 as it is lowered into the wellbore 120.

At least a portion of the body 210 may be composed of a degradable material. The body 210 is designed to be sufficiently rigid to provide structural integrity to the downhole tool, or frac plug 200. The body 210 may degrade in the wellbore environment such as when exposed to an aqueous fluid, an elevated wellbore temperature, a hydrocarbon fluid, and the like. The aqueous fluid may be any aqueous fluid present in the wellbore environment including, but not limited to, fresh water, saltwater, brine, seawater, or combinations thereof. The body 210 may thermally degrade in a wellbore environment having temperatures greater than about 93° C. (or about 200° F.). The body 210 may also degrade upon contact with a hydrocarbon fluid in the wellbore environment. In such cases, the hydrocarbon fluid may include, but is not limited to, alkanes, olefins, aromatic organic compounds, cyclic alkanes, paraffins, diesel fluids, mineral oils, desulfurized hydrogenated kerosenes, and any combination thereof. Suitable materials for forming the degradable portion of the body 210 may include, but are not limited to, a polysaccharide, chitin, chitosan, a protein, an aliphatic polyester, poly(ε-caprolactone), a poly(hydroxybutyrate), poly(ethyleneoxide), poly(phenyllactide), a poly (amino add), a poly(orthoester), polyphosphazene, a polylactide, a polyglycolide, a poly(anhydride) (e.g., poly(adipic anhydride), poly(suberic anhydride), poly(sebacic anhydride), poly(dodecanedioic anhydride), poly(maleic anhydride), and poly(benzoic anhydride), and the like), a polyepichlorohydrin, a copolymer of ethylene oxide/polyepichlorohydrin, a terpolymers of epichlorohydrin/ethylene oxide/allyl glycidyl ether, and any combination thereof. Suitable materials for forming the body 210 may also include, but are not limited to, metals or metal alloys that include magnesium, aluminum, iron, nickel, copper, gallium, zinc, zirconium, and the like, and any combination thereof. Combinations of the foregoing polymers and metals/metal alloys may be used in forming the body 210.

In some embodiments, the sealing element 285 may additionally be at least partially degradable. In such instances, the sealing element 285 is held in place by a retention mechanism 286 described herein to allow the degradation to more fully take place without allowing the sealing element 285 to flow back prior to complete or substantially complete (i.e., largely but not necessarily wholly) degradation. The sealing element 285 may be at least partially formed from a degradable elastomer including, but not limited to, a natural rubber or a synthetic rubber, such as ethylene propylene diene monomer (M-class) rubber, styrene-butadiene rubber, butyl rubber, polyurethane rubber; a polyester-based polyurethane rubber; a blend of chlorobutadiene rubber, reactive clay, and crosslinked sodium polyacrylate; a cellulose-based rubber (e.g., carboxy methyl cellulose); an acrylate-based polymer; a polyethylene glycol-based hydrogel; a silicone-based hydrogel; a polyacrylamide-based hydrogel; a polymacon-based hydrogel; a hyaluronic acid rubber; a polyhydroxobutyrate rubber; a polyester elastomer; a polyester amide elastomer; a polyamide elastomer; copolymers thereof; terpolymers thereof; and any combination thereof.

The degradable body 210 and/or sealing element 285 may degrade by a number of mechanisms, for example, by swelling, dissolving, undergoing a chemical change, undergoing thermal degradation in combination with any of the foregoing, and any combination thereof. Degradation by swell involves the absorption by the degradable material of a fluid (e.g., an aqueous fluid or a hydrocarbon fluid) in the wellbore environment such that the mechanical properties of the degradable material degrade. That is, the degradable material continues to absorb the aqueous fluid until its mechanical properties are no longer capable of maintaining its integrity and it at least partially falls apart. Degradation by dissolving involves use of a degradable material that upon contact with a fluid (e.g., an aqueous fluid or a hydrocarbon fluid) does not necessarily incorporate the fluid (as is the case with degradation by swelling), but becomes soluble upon contact with the fluid. Degradation by undergoing a chemical change may involve breaking the bonds of the backbone of the degradable material or causing the bonds of the degradable material to crosslink, such that it becomes brittle and breaks into small pieces upon contact with even small forces expected in the wellbore environment. Electrochemical processes include galvanic corrosion, electrochemical corrosion, stress corrosion cracking, crevice corrosion, and pitting. Thermal degradation of the degradable material involves a chemical decomposition due to heat, such as the heat present in a wellbore environment. Thermal degradation of some degradable material may occur at wellbore environment temperatures of greater than about 93° C. (or about 200° F.). Any of the foregoing degradation mechanisms may work in concert with one another.

The degradation rate of the degradable material may be accelerated, rapid, normal, or delayed, as defined herein. Accelerated degradation may be in the range of from a lower limit of about 30 minutes, 1 hour, 2 hours, 3 hours, 4 hours, 5 hours, and 6 hours to an upper limit of about 12 hours, 11 hours, 10 hours, 9 hours, 8 hours, 7 hours, and 6 hours, encompassing any value or subset therebetween. Rapid degradation may be in the range of from a lower limit of about 12 hours, 1 day, 2 days, 3 days, 4 days, and 5 days to an upper limit of about 10 days, 9 days, 8 days, 7 days, 6 days, and 5 days, encompassing any value or subset therebetween. Normal degradation may be in the range of from a lower limit of about 12 days, 13 days, 14 days, 15 days, 16 days, 17 days, 18 days, 19 days, 20 days, 21 days, 22 days, 23 days, 24 days, 25 days, and 26 days to an upper limit of about 40 days, 39 days, 38 days, 37 days, 36 days, 35 days, 34 days, 33 days, 32 days, 31 days, 30 days, 29 days, 28 days, 27 days, and 26 days, encompassing any value or subset therebetween. Delayed degradation may be in the range of from a lower limit of about 2 months, 2.5 months, 3 months, 3.5 months, 4 months, 4.5 months, 5 months, 5.5 months, 6 months, 6.5 months, 7 months, 7.5 months, 8 months, 8.5 months, 9 months, 9.5 months, and 10 months to an upper limit of about 18 months, 17.5 months, 17 months, 16.5 months, 16 months, 15.5 months, 15 months, 14.5 months, 14 months, 13.5 months, 13 months, 12.5 months, 12 months, 11.5 months, 11 months, 10.5 months, and 10 months, encompassing any value or subset therebetween. Accordingly, the degradation may be between about 30 minutes to about 18 months, depending on a number of factors including, but not limited to, the type of degradable material selected, the conditions of the wellbore environment, and the like.

Referring again to FIG. 2, in operation the frac plug 200 may be used in a downhole fracturing operation to isolate a zone of the formation 115 below the frac plug 200. The downhole tools of the present disclosure beneficially comprise a retention mechanism 286 capable of maintaining the sealing element 285 in place while degradation of the body 210 takes place (and also degradation of the sealing element 285 if it is degradable). By so maintaining the sealing element 285, portions of the downhole tool that have either not degraded or degraded only partially remain in place and do not flowback to the surface. In some embodiments, the retention mechanism may be an adhesive applied to or integral to the sealing element, so as to be in contact therewith. For example, in one embodiment, the adhesive may be applied to an outer diameter of the sealing element 285 such that when the frac plug 200 is placed into a wellbore during a downhole fracturing operation, for example, and actuated to fluidly seal two sections of the wellbore, the adhesive contacts either the wellbore itself (i.e., the face of the subterranean formation) or the casing 125. Upon contact, the adhesive works to hold the sealing element 285 in place while the operation is performed and while the body 210 is degraded. The adhesive is not necessary for the sealing element 285 to fluidly seal the two sections of the wellbore, but rather provides contact with the wellbore during degradation of the body 210, even if the fluid seal between the wellbore and the sealing element 285 is lost. The adhesive may be integral to the sealing element 285 such that when the frac plug 200 is actuated and the sealing element 285 expands to contact the formation or casing in a wellbore to set the frac plug 200, the adhesive is squeezed out of the sealing element 285. As such, the adhesive contacts the sealing element 285 to hold it in place during the degradation of the body 210.

In other embodiments, the retention mechanism 286 is an adhesive applied to or integral to the body 210. During actuation of the frac plug 200, the adhesive is either pushed or squeezed out of or from the body 210 so as to come into contact with the sealing element 285 and anchor the sealing element 285 in place during degradation of the body 210. In one embodiment, a portion of the body 210 may have the adhesive applied or integral to it, such that the adhesive physically contacts the sealing element 285 during actuation and the physical contact anchors the sealing element 285 in place. In another embodiment, for example, the adhesive is stored in an enclosure 275 mounted on the body 210 or may be formed integrally therein. The enclosure 275 may be formed of a frangible material that breaks during actuation of the frac plug 200, thereby permitting escape of the adhesive from the enclosure 275 to flow down and contact the sealing element 285. It will be appreciated that the location of the enclosure 275 relative to the frac plug 200 may be at any location provided that upon breaking the enclosure 275 during actuation, it allows the adhesive to flow into contact with the sealing element 285. For example, in some embodiments, the enclosure 275 may be at one or more junctions between the upper sealing element 232, the center sealing element 234, and/or the lower sealing element 236. In other embodiments, one or more slips 240 are mounted around the body 210 and are guided by a mechanical slip body 245. During actuation of the frac plug 200, the slips are set to grip the wellbore formation or casing and the setting of the slips 240 causes release of the adhesive from the enclosure 275, such as by a mechanical mechanism. Although the slips of FIG. 2 are shown below the sealing element 285, they may be located at any location on the frac plug 200 without departing from the scope of the present disclosure.

The adhesive may take any form capable of contacting the sealing element 285 and maintaining the sealing element 285 in place during degradation of the body 210. For example, the adhesive may take the form of a film or a tape, a liquid, an emulsion, and the like. In some embodiments, the adhesive may be inert or otherwise inactive until the frac plug 200 is set in place in the wellbore. In some embodiments, the adhesive is a pressure-activated adhesive, a temperature-activated adhesive, or an curable resin adhesive. The pressure-activated adhesive may allow the frac plug 200 to be actuated downhole without the adhesive being activated until such actuation because of the pressure applied to the sealing element 285, for example (i.e., the force of the actuation activates the pressure-activated adhesive). Suitable pressure-activated adhesives may include, but are not limited to, an acrylic polymer-based adhesive, a rubber-based cold seal adhesive, a hot melt adhesive (e.g., a polyolefin, such as polyester, polypropylene, polyethylene, a propylene/ethylene copolymer, and the like), styrene/isoprene/styrene terpolymer, and any combination thereof. Suitable commercially available pressure-activated adhesives may include, but are not limited to, Adhesive Transfer Tapes 486MP, 950, 9472LE, and F9473PC and Double Coated Tapes 9786 and 9832, each available from 3M™ in Saint Paul, Minn. Styrene/isoprene/styrene terpolymer may additionally act as a hot melt adhesive. Suitable styrene/isoprene/styrene terpolymers may include, but are not limited to KRATON® D SIS, available from Kraton Polymers U.S. LLC, in Houston, Tex. and CREABLOC®SIS, available from Evonik Industries AG, in Essen, Germany.

In some embodiments, the adhesive is a temperature-activated adhesive that is activated at elevated temperatures, such as downhole temperatures naturally occurring in a wellbore. In some embodiments, the downhole temperature also accelerates activation and/or curing of the non-temperature-activated adhesives described herein (i.e., the pressure-activated adhesives and/or the curable adhesive). The adhesives may also be both pressure-activated and temperature-activated such that at a particular temperature, the adhesive becomes pressure sensitive. Suitable temperature-activated adhesives may include, but are not limited to, acrylic acid, an acrylic acid derivative, a methacrylic acid, a methacrylic acid derivative, a polymethacrylic acid, a polymethacrylic acid derivative, a silicone polymer (e.g., silicone polyureas), a polyester, a polyurethane, and any combination thereof. Copolymers, terpolymers, graft copolymers, and block copolymers of acrylic acid, methacrylic acid, and/or polymethacrylic acid.

The adhesive suitable for use as the retention mechanism described herein may additionally be a curable resin. Suitable curable resins include all resins known in the art that are capable of forming a hardened, consolidated mass. Some suitable resins include two component epoxy based resins, novolak resins, polyepoxide resins, phenol-aldehyde resins, urea-aldehyde resins, urethane resins, phenolic resins, furan resins, furan/furfuryl alcohol resins, phenolic/latex resins, phenol formaldehyde resins, silicon-based resins, polyester resins and hybrids and copolymers thereof, polyurethane resins and hybrids and copolymers thereof, acrylate resins, silicon-based resins, and mixtures thereof. Some suitable resins, such as epoxy resins, may be cured with an internal catalyst or activator so that when pumped down hole, they may be cured using only time and temperature. Other suitable resins, such as furan resins, generally require a time-delayed catalyst or an external catalyst to help activate the polymerization of the resins if the cure temperature is low (i.e., less than 250° F.), but will cure under the effect of time and temperature if the formation temperature is above about 250° F., preferably above about 300° F.

In addition to holding the sealing element 285 in place, the adhesives described in the present disclosure may further be applied or form an integral part of additional elements of the frac plug 200. For example, one or more of the slips 240 may be configured to retain non-degraded portions of the body and release degraded portions of the body such as by, for example, applying one or more of the adhesives to the slips 240. As such, the slips 240 would be held into place by the adhesive against the formation or casing in the wellbore so that the body does not move during degradation. Additionally, the coating of the teeth of the slips 240 with an adhesive described herein may permit the teeth to be made of a non-degradable material such as ceramic, a hardened metal, and the like.

In some embodiments, the retention mechanism 287 may be a mechanical device that mechanically holds the sealing element 285 in place without assistance from the body 210. For example, during actuation of the frac plug 200, the mechanical device may itself be activated to spring open, for example, and hold the sealing element 285 against the subterranean formation or the casing in the wellbore. In some embodiments, the mechanical device may be a c-ring, a collet, or other mechanical device capable of springing open upon actuation of the frac plug 200 either by the physical movement of the frac plug 200 during actuation, an electrical signal, or a mechanical connection. In other embodiments, the mechanical device forming the retention mechanism 287 is in an elastically-strained, collapsed state during run-in of the frac plug 200 into the wellbore and during actuation the strained state is removed, allowing the mechanical device retention mechanism 287 to expand and pressure the sealing element 285 against the formation or casing in the wellbore. In one embodiment, this may be accomplished by physically deforming a component that would hold the sealing element 285 in place, such as a solid expandable tube. In another embodiment, the mechanical device is a magnet and the magnetic attraction between the magnet and metal casing 125 in the subterranean formation creates a holding force that retains the sealing element 285 in place.

Referring again to FIG. 1, removing the downhole tool 100 from its attachment in the wellbore 120 is more cost effective and less time consuming than removing conventional downhole tools, which require making one or more trips into the wellbore 120 with a mill or drill to gradually grind or cut the tool away. Instead, the downhole tools 100 described herein are removable by simply exposing the tools 100 to a naturally occurring or standard downhole environment (e.g., fluids present in a standard downhole operation, temperatures in a downhole environment) over time. The foregoing descriptions of specific embodiments of the downhole tool 100, and the systems and methods for removing the downhole tool 100 from the wellbore 120 have been presented for purposes of illustration and description and are not intended to be exhaustive or to limit this disclosure to the precise forms disclosed. Many other modifications and variations are possible. In particular, the type of downhole tool 100, or the particular components that make up the downhole tool 100 (e.g., the body and sealing element) may be varied. For example, instead of a frac plug 200 (FIG. 2), the downhole tool 100 may comprise a bridge plug, which is designed to seal the wellbore 120 and isolate the zones above and below the bridge plug, allowing no fluid communication in either direction. Alternatively, the biodegradable downhole tool 100 could comprise a packer that includes a shiftable valve such that the packer may perform like a bridge plug to isolate two formation zones, or the shiftable valve may be opened to enable fluid communication therethrough. Similarly, the downhole tool 100 could comprise a wiper plug or a cement plug.

While various embodiments have been shown and described herein, modifications may be made by one skilled in the art without departing from the scope of the present disclosure. The embodiments described here are exemplary only, and are not intended to be limiting. Many variations, combinations, and modifications of the embodiments disclosed herein are possible and are within the scope of the disclosure. Accordingly, the scope of protection is not limited by the description set out above, but is defined by the claims which follow, that scope including all equivalents of the subject matter of the claims.

Embodiments disclosed herein include Embodiment A, Embodiment B, and Embodiment C.

Embodiment A

A downhole tool comprising: a body and at least one sealing element, wherein at least a portion of the body is degradable when exposed to a wellbore environment; and a retention mechanism configured to retain the sealing element in place during degradation of the portion of the body that is degradable, wherein the downhole tool is capable of actuating to fluidly seal two sections of the wellbore with the sealing element.

Embodiment A may have one or more of the following additional elements in any combination:

Element A1: Wherein the retention mechanism is an adhesive applied to or integral to the sealing element so as to be in contact therewith.

Element A2: Wherein the adhesive is at least one of a pressure-activated adhesive, temperature-activated adhesive, and curable adhesive.

Element A3: Wherein the retention mechanism is an adhesive applied to or integral to the body, and wherein actuation of the downhole tool causes the adhesive to contact the sealing element.

Element A4: Wherein the retention mechanism is an adhesive applied to or integral to the body, and wherein actuation of the downhole tool causes the adhesive to contact the sealing element, the adhesive being at least one of a pressure-activated adhesive, temperature-activated adhesive, and curable adhesive.

Element A5: Wherein the retention mechanism is a mechanical device, and wherein actuation of the downhole tool causes the mechanical device to contact the sealing element.

Element A6: Wherein the retention mechanism is a mechanical device comprising a magnet.

Element A7: Wherein the body comprises at least one slip configured to contact the body and retain non-degraded portions of the body and release degraded portions of the body.

Element A8: Wherein at least a portion of the sealing element is degradable.

By way of non-limiting example, exemplary combinations applicable to Embodiment A include: A with A1 and A2; A with A3, A4, and A8; A with A7 and A8; A with A4 and A5; A with A1, A6, and A7; A with A2 and A5.

Embodiment B

A method comprising: installing a downhole tool in a wellbore having a wellbore environment, wherein the downhole tool comprises: a body and at least one sealing element, wherein at least a portion of the body is degradable when exposed to a wellbore environment, and a retention mechanism configured to retain the sealing element in place during degradation of the portion of the body that is degradable; actuating the downhole tool to fluidly seal two sections of the wellbore with the sealing element; performing a downhole operation; degrading at least a portion of the body, wherein the retention mechanism retains the sealing element during degradation of the portion of the body.

Embodiment B may have one or more of the following additional elements in any combination:

Element B1: Wherein the retention mechanism is an adhesive applied to or integral to the sealing element so as to be in contact therewith.

Element B2: Wherein the adhesive is at least one of a pressure-activated adhesive, temperature-activated adhesive, and curable adhesive.

Element B3: Wherein the retention mechanism is an adhesive applied to or integral to the body, and wherein actuation of the downhole tool causes the adhesive to contact the sealing element.

Element B4: Wherein the retention mechanism is an adhesive applied to or integral to the body, and wherein actuation of the downhole tool causes the adhesive to contact the sealing element, the adhesive being at least one of a pressure-activated adhesive, temperature-activated adhesive, and curable adhesive.

Element B5: Wherein the retention mechanism is a mechanical device, and wherein actuation of the downhole tool causes the mechanical device to contact the sealing element.

Element B6: Wherein the retention mechanism is a mechanical device comprising a magnet.

Element B7: Wherein the body comprises at least one slip configured to contact the body and retain non-degraded portions of the body and release degraded portions of the body.

Element B8: Wherein at least a portion of the sealing element is degradable.

Element B9: Wherein the downhole operation is a fluid injection operation.

By way of non-limiting example, exemplary combinations applicable to Embodiment B include: B with B1 and B9; B with B4, B5, and B8; B with B3 and B7; B with B5 and B9; B with B3, B6, and B8; B with B2, B3, and B9.

Embodiment C

A system comprising: a wellbore having a wellbore environment; and a downhole tool capable of actuating in the wellbore to fluidly seal two sections thereof, the downhole tool comprising: a body and at least one sealing element, wherein at least a portion of the body is degradable when exposed to a wellbore environment, and a retention mechanism configured to retain the sealing element in place during degradation of the portion of the body that is degradable.

Embodiment C may have one or more of the following additional elements in any combination:

Element C1: Wherein the retention mechanism is an adhesive applied to or integral to the sealing element so as to be in contact therewith.

Element C2: Wherein the adhesive is at least one of a pressure-activated adhesive, temperature-activated adhesive, and curable adhesive.

Element C3: Wherein the retention mechanism is an adhesive applied to or integral to the body, and wherein actuation of the downhole tool causes the adhesive to contact the sealing element.

Element C4: Wherein the retention mechanism is an adhesive applied to or integral to the body, and wherein actuation of the downhole tool causes the adhesive to contact the sealing element, the adhesive being at least one of a pressure-activated adhesive, temperature-activated adhesive, and curable adhesive.

Element C5: Wherein the retention mechanism is a mechanical device, and wherein actuation of the downhole tool causes the mechanical device to contact the sealing element.

Element C6: Wherein the retention mechanism is a mechanical device comprising a magnet.

Element C7: Wherein the body comprises at least one slip configured to contact the body and retain non-degraded portions of the body and release degraded portions of the body.

Element C8: Wherein at least a portion of the sealing element is degradable.

By way of non-limiting example, exemplary combinations applicable to Embodiment C include: C with C8; C with C1, C2, and C6; C with C4 and C5; C with C7 and C8; C with C3, C4, and C8; C with C1 and C3; C with C4 and C7.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces.

The invention claimed is:

1. A downhole tool comprising:

a body and at least one sealing element, wherein the body retains the sealing element at a downhole location and at least a portion of the body is degradable when exposed to an environment of a wellbore, the at least one sealing element being degradable by swelling due to absorption of a fluid; and a retention mechanism integral to the sealing element, the retention mechanism configured to retain the at least one sealing element in place by contacting either a face of a subterranean formation or by contacting a casing in the wellbore at the downhole location during degradation of the portion of the body, wherein the downhole tool is capable of actuating to fluidly seal two sections of the wellbore with the sealing element, wherein the retention mechanism is a mechanical device comprising a magnet.

2. The downhole tool of claim 1, further comprising an additional retention mechanism, the additional retention mechanism being an adhesive integral to the body, and wherein actuation of the downhole tool causes the adhesive to contact the sealing element.

3. The downhole tool of claim 2, wherein the adhesive is at least one of a pressure-activated adhesive, temperature-activated adhesive, and curable adhesive.

4. The downhole tool of claim 1, wherein the body comprises at least one slip configured to contact the body and retain non-degraded portions of the body and release degraded portions of the body.

5. A method comprising:

installing a downhole tool in a wellbore having a wellbore environment, wherein the downhole tool comprises:

a body and at least one sealing element, wherein at least a portion of the body is degradable when exposed to the wellbore environment, the at least one sealing element being degradable by swelling due to absorption of a fluid;

a retention mechanism integral to the sealing element, the retention mechanism configured to retain the sealing element at a downhole location during degradation of the portion of the body, wherein the retention mechanism is both pressure-activated and temperature-activated, wherein at a particular temperature the retention mechanism becomes pressure sensitive;

actuating the downhole tool to fluidly seal two sections of the wellbore with the sealing element, the actuating causing the retention mechanism to retain the sealing element in place by contacting either a face of a subterranean formation or by contacting a casing in the wellbore at the downhole location during degradation of the portion of the body;

retaining the sealing element at the downhole location via the body at an initial integrity;

performing a downhole operation; and degrading the portion of the body, wherein the retention mechanism retains the sealing element at the downhole location during degradation of the portion of the body.

6. The method of claim 5, wherein the retention mechanism is an adhesive integral to the sealing element so as to be in contact therewith.

7. The method of claim 5, further comprising an additional retention mechanism, the additional retention mechanism being an adhesive integral to the body, and wherein actuation of the downhole tool causes the adhesive to contact the sealing element.

8. The method of claim 7, wherein the adhesive is at least one of a pressure-activated adhesive, temperature-activated adhesive, and curable adhesive.

9. The method of claim 5, wherein the body comprises at least one slip configured to contact the body and retain non-degraded portions of the body and release degraded portions of the body.

10. The method of claim 5, wherein the downhole operation is a fluid injection operation.

11. A method comprising:

installing a downhole tool in a wellbore having a wellbore environment, wherein the downhole tool comprises:

a body and at least one sealing element, wherein at least a portion of the body is degradable when exposed to the wellbore environment, the at least one sealing element being degradable by swelling due to absorption of a fluid;

a retention mechanism integral to the sealing element, the retention mechanism configured to retain the sealing element at a downhole location during degradation of the portion of the body, wherein the retention mechanism is a mechanical device comprising a magnet;

actuating the downhole tool to fluidly seal two sections of the wellbore with the sealing element, the actuating causing the retention mechanism to retain the sealing element in place by contacting either a face of a subterranean formation or by contacting a casing in the wellbore at the downhole location during degradation of the portion of the body;

retaining the sealing element at the downhole location via the body at an initial integrity;

performing a downhole operation; and degrading the portion of the body, wherein the retention mechanism retains the sealing element at the downhole location during degradation of the portion of the body.

12. A downhole tool comprising:

a body and at least one sealing element, wherein the body retains the sealing element at a downhole location and at least a portion of the body is degradable when exposed to an environment of a wellbore, the at least one sealing element being degradable by swelling due to absorption of a fluid; and a retention mechanism integral to the sealing element, the retention mechanism configured to retain the at least one sealing element in place by contacting either a face of a subterranean formation or by contacting a casing in the wellbore at the downhole location during degradation of the portion of the body, wherein the downhole tool is capable of actuating to fluidly seal two sections of the wellbore with the sealing element, wherein at a particular temperature the retention mechanism becomes pressure sensitive.

* * * * *